US010240314B2

(12) United States Patent
Hodge

(10) Patent No.: US 10,240,314 B2
(45) Date of Patent: Mar. 26, 2019

(54) APPARATUS AND METHOD TO ENHANCE THE UTILITY OF HYDRODYNAMIC COMPACTION MACHINE

(71) Applicant: William Eugene Hodge, Vancouver (CA)

(72) Inventor: William Eugene Hodge, Vancouver (CA)

( * ) Notice: Subject to any disclaimer, the term of this patent is extended or adjusted under 35 U.S.C. 154(b) by 10 days.

(21) Appl. No.: 15/957,640

(22) Filed: Apr. 19, 2018

(65) Prior Publication Data

US 2018/0363264 A1 Dec. 20, 2018

Related U.S. Application Data

(60) Provisional application No. 62/520,845, filed on Jun. 16, 2017.

(51) Int. Cl.

| | |
|---|---|
| ***E02D 3/00*** | (2006.01) |
| ***E02D 3/02*** | (2006.01) |
| ***E02D 3/046*** | (2006.01) |
| ***E02D 3/054*** | (2006.01) |
| ***E02D 3/10*** | (2006.01) |

(52) U.S. Cl.
CPC ..... *E02D 3/054* (2013.01); *E02D 3/10* (2013.01)

(58) Field of Classification Search
CPC ..... E01C 19/288; E01C 19/30; E01C 19/32; E01C 19/34; E01C 19/35; E01C 19/36; E01C 19/38; E02D 3/02; E02D 3/046; E02D 3/054; E02D 3/068; E02D 3/074; E02D 5/22; E02D 7/00; E02D 11/00; E02D 5/34; E02D 5/46; E02D 15/04; E02D 27/12; E02D 5/30; E02D 5/808; E02D 7/24
USPC ..... 405/231–252.1, 271; 404/133.05, 133.1, 404/133.2, 113; 366/117, 108, 120–123; 175/55, 56, 19, 106; 61/53.5, 36
See application file for complete search history.

(56) References Cited

U.S. PATENT DOCUMENTS

| | | | | | |
|---|---|---|---|---|---|
| 1,005,770 | A * | 10/1911 | Clark | E21B 4/06 | 173/125 |
| 1,457,181 | A * | 5/1923 | Mable | E21B 4/06 | 173/125 |
| 1,607,082 | A * | 11/1926 | Howcott | E21B 4/10 | 173/205 |
| 2,390,646 | A * | 12/1945 | Hays | E21B 4/02 | 173/218 |
| 3,151,687 | A * | 10/1964 | Sato | E21B 7/26 | 175/21 |
| 3,245,223 | A * | 4/1966 | Degen | E02D 3/054 | 173/49 |
| 3,309,877 | A * | 3/1967 | Degen | E02D 3/054 | 175/1 |

(Continued)

*Primary Examiner* — Benjamin F Fiorello
*Assistant Examiner* — Edwin J Toledo-Duran

(57) ABSTRACT

An apparatus intended for incorporation as a module within ground improvement pokers such as those already patented (U.S. Pat. Nos. 6,554,543 and 8,419,316) in order to enhance the field performance of those hydrodynamic compactors by either improving their ground penetration capability, and/or, maintaining or recovering the permeability of their outer seepage filtration element; involving a method which can be activated remotely at the operator's discretion, while those parent devices are at depth within the earth. This apparatus and method may have application in water well installations and reviving flow in oil wells.

3 Claims, 3 Drawing Sheets

(56) References Cited

U.S. PATENT DOCUMENTS 3,480,092 A * 11/1969 Reinold ..... E21B 7/26 173/93
3,648,467 A * 3/1972 Ogawa ..... E02D 3/106 405/240
3,800,889 A * 4/1974 Bauer ..... E02D 3/054 175/19
3,832,858 A * 9/1974 Anders ..... E02D 7/26 173/24
3,952,813 A * 4/1976 Chepurnoi ..... E21B 4/145 173/91
4,058,175 A * 11/1977 Holland ..... E02D 7/08 173/1
4,576,521 A * 3/1986 Conrad ..... B63B 21/26 114/293
4,637,476 A * 1/1987 Gurkov ..... E21B 4/145 173/136
4,700,776 A * 10/1987 Petrovic ..... E21B 43/082 166/157
4,877,353 A * 10/1989 Wisotsky, Sr. ..... B09B 1/002 588/17
5,234,061 A * 8/1993 Hesse ..... E21B 4/145 173/136
5,301,758 A * 4/1994 Jenne ..... E21B 4/145 173/91
5,697,733 A * 12/1997 Marsh, Jr. ..... E02D 3/046 172/40
6,554,543 B2 * 4/2003 Hodge ..... E02D 3/054 366/123
8,419,316 B2 * 4/2013 Hodge ..... E02D 3/054 405/271
2015/0023739 A1 * 1/2015 Coulon ..... E02D 5/72 405/233
2015/0086277 A1 * 3/2015 Hodge ..... E02D 3/054 405/271

* cited by examiner

Sections A-A

APPARATUS AND METHOD TO ENHANCE THE UTILITY OF HYDRODYNAMIC COMPACTION MACHINE

CROSS-REFERENCE TO RELATED APPLICATIONS

This application claims priority under 35 U.S.C 119(e) to U.S. Provisional Patent application No. 62/520,845 filed Jun. 16, 2017, the disclosure of which is incorporated herein by reference.

BACKGROUND OF THE INVENTION

The apparatus and method described herein are believed to constitute substantial benefits towards the utility and performance of the hydrodynamic compaction machine which is defined in U.S. Pat. No. 6,554,543 and to the groundwater cleanup configuration described in U.S. Pat. No. 8,419,316. The current applicant was the sole inventor of both those patents, and is also the sole owner of the intellectual property associated with these.

The novelty cited here is a module to be incorporated within the existing hydrodynamic compactor, a machine which is mainly for use in the Ground Improvement sector of geotechnical engineering and environmental remediation, however, it may have some application in water well development and petroleum recovery from oil wells.

SUMMARY OF THE INVENTION

Objects and Advantages

The environment in which the hydrodynamic compactor is typically put to work is within relatively weak or loose soils at some depth below the water table. Depending on the project, this tool will be deployed for the purposes of improving the engineering parameters on which the behavior of the soil, or other particulate mass, depends for stability. In other situations it may be employed to withdraw contaminated water from the ground surrounding it for environmental reasons. In such cases it is normal practice to push the machine down to the desired depth by applying an external vertical force to it. This force may be generated by such means as a custom designed hydraulic piston attached to a weighty deployment vehicle.

One of the benefits associated with the incorporation of the apparatus cited herein is its capacity to produce vertical impact blows internally at the bottom end of the apparatus, in combination with the friction-reduction of the outer cylindrical surface of the compactor by means of pressurized water exhausted locally. Taken together, these two factors could in many cases result in the machine entering the ground itself, without the need for any externally applied vertical force from a deployment vehicle.

In weaker ground environments, such as deltaic deposits and mine tailings of various gradations, the filter component of the well screen may be rendered inoperative by virtue of the open spaces between its helically wound wire filter being plugged by cohesive layers existing within the material to be treated. Here is where a second benefit of this apparatus can be brought into play, rectifying this situation by removing such smearing remotely. And, most importantly, accomplishing this while the machine is still at depth, in other words, without having to withdraw and expose the well screen above ground level. This is affected simply by the operator reversing the rotational direction of the drive shaft, thereby causing pressurized water jets to be emitting up between the ribs of the well screen, while at the same time causing the screen to vibrate vertically.

BRIEF DESCRIPTION OF THE DRAWINGS

The upper part of both

In order to give some practical context to this module it is shown against the background of the lower part of the hydrodynamic compactor which is hereinafter referred to as its parent device, and to which it has particular application.

Figure 1:
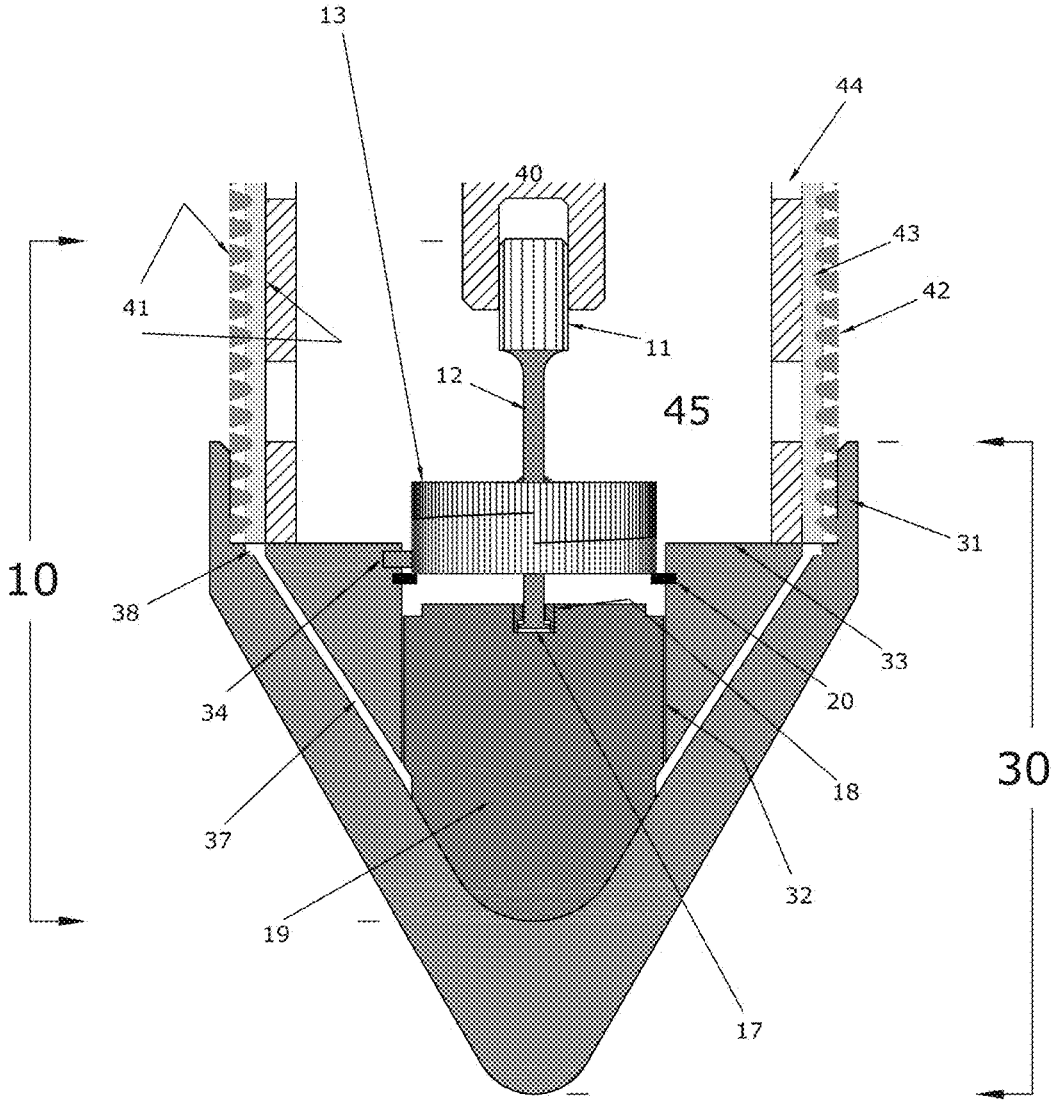
FIG. 1 and FIG. 2 show, in profile, the active parts of the module which is the apparatus of the novelty claimed herein.
Figure 2:
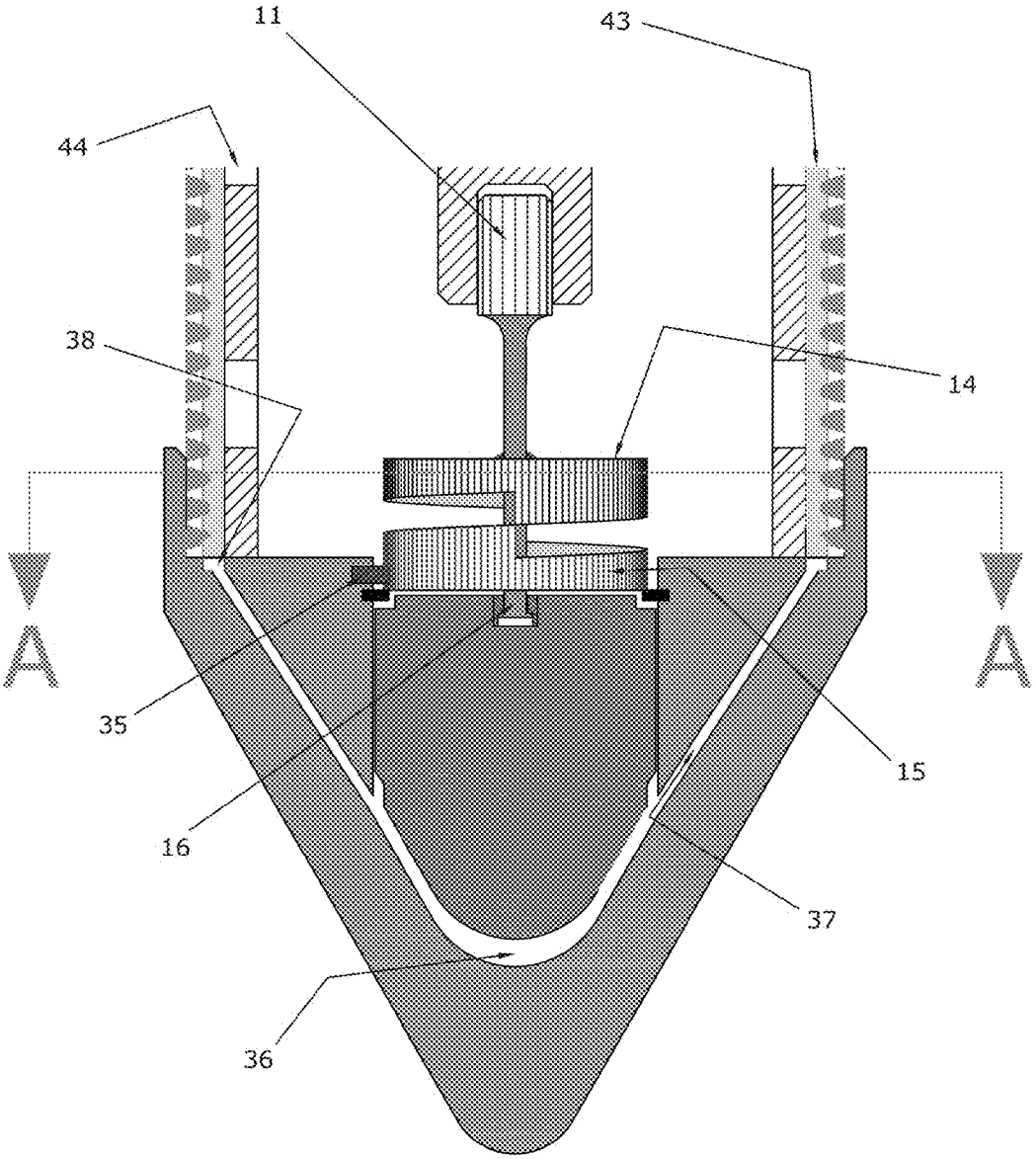

The difference between these two figures is that FIG. 1 shows the mechanism while it is being turned in a clockwise direction, as viewed from overhead, whereas FIG. 2 shows this same set of elements when the driveshaft is causing rotation in the opposite, counterclockwise direction.

Figure 3:
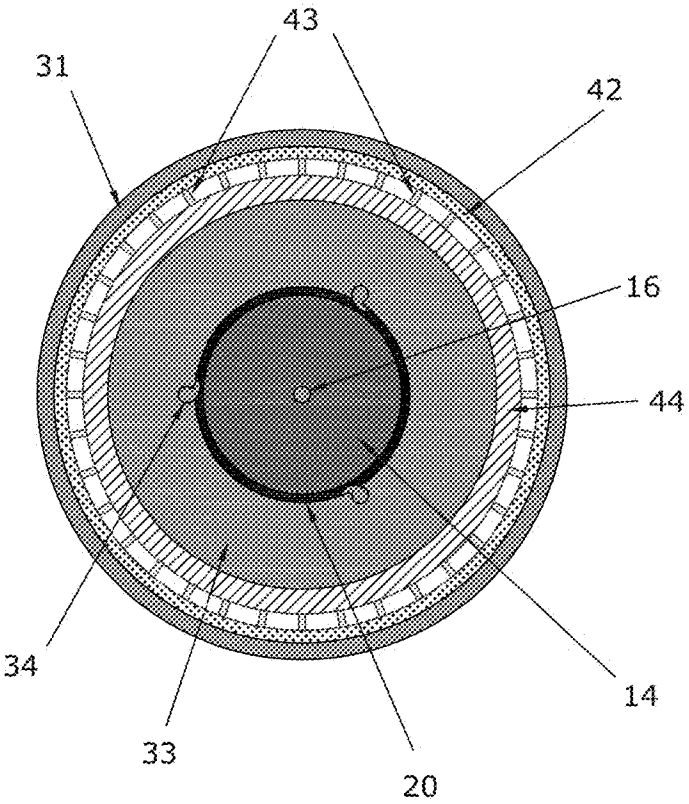

FIG. 3 shows a plan view of a section cut through the module at the level indicated by Section A-A in FIG. 2.

Figure 4:
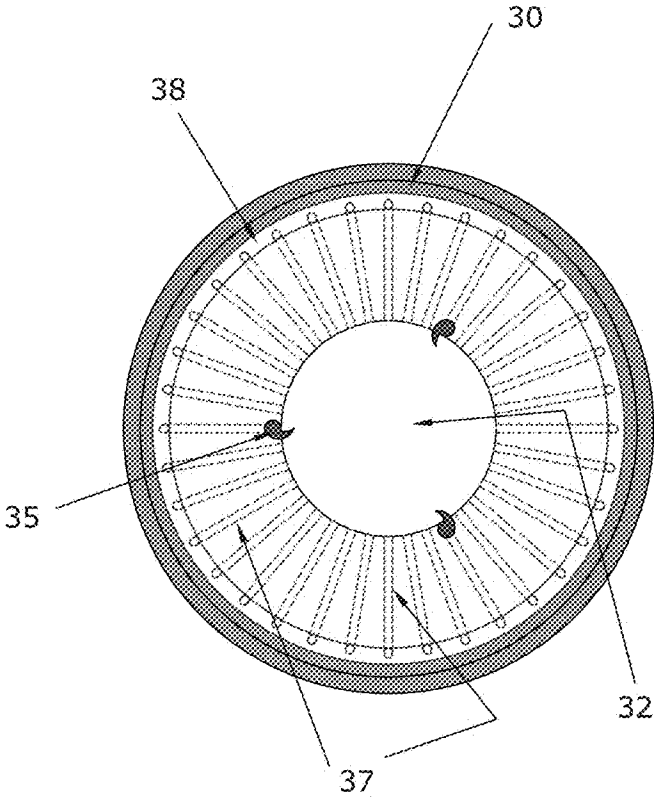

FIG. 4 is the same section but with the module having been removed so as to allow the water passageways to be seen.

DESCRIPTION OF PREFERRED EMBODIMENT

Detailed Description of Apparatus

For the purpose of describing the apparatus and explaining the method of its operation it is considered best to do so in the specific case of its embodiment as a module added to the existing hydrodynamic compaction machine.

| LIST OF REFERENCE NUMERALS | |
|---|---|
| 10 | module |
| 11 | spline shaft |
| 12 | upper drive shaft |
| 13 | spiral coupling |
| 14 | top half of coupling |
| 15 | bottom half of coupling |
| 16 | lower drive shaft |
| 17 | hanger |
| 18 | hanger housing |
| 19 | dead weight |
| 20 | retaining ring |
| 30 | nose cone |
| 31 | nose cone collar |
| 32 | nose cone cavity |
| 33 | shoulder of nose cone |
| 34 | pawl free |
| 35 | pawl fixed |
| 36 | water under dead weight |
| 37 | water conduit |
| 38 | water groove |
| 40 | main rotational drive |
| 41 | well screen |
| 42 | well screen filter |
| 43 | well screen ribs |
| 44 | perforated pipe |
| 45 | water reservoir |

FIG. 1 shows the module 10 encased within the nose cone 30 of the current standard configuration of the hydrodynamic compactor, that is, its parent device.

The nose cone 30 is shaped to facilitate ground penetration, and it is formed from mild steel.

The uppermost component of the module 10 is a somewhat loosely fitting spline shaft 11 which is an integral part of the upper drive shaft 12. This shaft 12 is fixedly connected to the top of the spiral coupling 13.

The spline shaft 11 is provided with some vertical and lateral slack. This is to prevent vertical forces emanating from the dynamics involved in the movements of the module 10 having too intimate a connection with the main rotational drive 40, and thereby effecting mechanisms higher up the parent device. The lateral slack in spline shaft 11 also allows it to rise and fall, with minimal resistance, when moving in compliance with the excursions of the upper half 14 of the spiral coupling.

The spiral coupling 13 is made of heat-treated steel which is stress relieved and case hardened so as to endure repeated impact loading.

With reference to FIG. 2, having passed through the top half of the spiral coupling 14 the drive shaft 12 then passes freely through the bottom half of the coupling 15. The lower end of the drive shaft 16 terminates in a hanger 17 shown in FIG. 1 as a simple broadening of the diameter of 16. This hanging device resides within a housing 18 which is fixed within the dead weight 19.

The dead weight 19 is formed of metal, and advantageously, to some extent is composed of lead (Pb).

The bottom half of the spiral coupling 15 is supported vertically by retaining ring 20 inserted in the wall of the nose cone cavity 32.

All components in FIG. 1 and FIG. 2 are identical. The difference being that in FIG. 1 the module 10 is being driven by the main rotational drive 40 so as to rotate in its normal ground improvement functionality (clockwise as seen from above); whereas in FIG. 2 the module 10 is being driven in the counterclockwise direction which causes the spiral coupling 13 to come apart in a manner which activates the novel functionality of 10.

The rotational freedom of the bottom half of the spiral coupling 15 is controlled by spring-loaded pawls 34 and 35 which are also fixed into the wall of the nose cone cavity 32. When the main rotational drive 40 is causing clockwise motion of the top half of the spiral coupling 14 the pawl 34 allows free rotation of the bottom half of the spiral coupling 15 and the two halves 14 and 15 remain in intimate contact as shown on FIG. 1, with no effect on the dead weight 19 because the hanger 17 is kept disengaged from contact with it. Also, while this direction of rotation persists, the functioning of the hardware pieces higher up in the parent device perform their normal functions and are not affected by module 10.

The dimensions of the hanger 17 are chosen so that when the two halves of the spiral coupling 13 are mated and moving together in the same direction, then the hanger 17 is held out of contact with the dead load 19.

On the other hand, as shown in FIG. 2, once the main rotational drive 40 causes rotation of the top half of the spiral coupling 14 in a counterclockwise direction, the bottom half of the spiral coupling 15 is prevented from following 14 by the spring-loaded pawl becoming fixed 35. The top half 14 is thereby forced by its continued rotation to ride up on the lower half 15, and in doing so brings the hanger 17 into vertical engagement with the dead weight 19 and lifts it up in conformity with the elevation of the upper half 14 of the spiral coupling.

While 19 is being elevated the vacated space in the nose cone cavity 32 beneath it is filled by water 36 from the reservoir 45 entering through water conduits 37.

There comes a crisis point each time the top half 14 completes a full (360°) horizontal counterclockwise turn, that is, as soon as the lower half 15 is no longer in a position to support the elevated state of 14. In consequence 14 falls down to its original height, and in so doing drops the deadweight 19 too. As 19 reoccupies its at-rest position within the nose cone 30 it instantly pressurizes the water 36 which has, during the excursion of 30, entered that vacated space.

Water conduits 37 provided escape passageways for this water 36. This plurality of holes 37 are drilled from a groove 38 which extends around the top perimeter of the shoulder of the nose cone 33 immediately beneath the well screen ribs 43 and of the same width as the ribs. The inclination of these holes is made so as to align with the bottom shape of that inner cavity 32. This geometric arrangement avoids the possibility of pressurized water 36 being inadvertently blocked in the event that the discharge ends of these vents 37 emerge directly beneath the well screen ribs 43.

The parts of the parent device above the nose cone, and which contribute to its viability are as follows: the main rotational drive 40; the well screen 41 comprised of its filter element 42 and its supporting ribs 43; and the structural supporting perforated pipe 44. The well screen 41 and the perforated pipe 44 admit water flow from the ground water outside the parent device so as to provision the water reservoir 45.

The well screen 41 is made of stainless steel.

FIG. 3 and FIG. 4 show the components exposed by plan Section A-A as described above. In addition to the aforementioned parts the nose cone collar 31 and the shoulder of the nose cone 33 are pointed out.

Operation of Invention

In each of its geotechnical applications the apparatus would be incorporated into the hydrodynamic compactor poker as its bottommost module. The poker with the module protected within this elongated cylindrical steel device would be positioned over the ground at the desired location by a mobile crane, or similar hoisting device.

In order to enter the ground penetration mode the procedure would be as follows:

a. The normal dewatering function would be deactivated.

b. Water would be added to the top of the deployment casing in order to fill the reservoir above the module and to flood the lower part of the well screen and its perforated support tube.

c. The drive shaft would be activate in the counterclockwise rotation at a rate of about 15 to 30 RPM.

d. The nose cone would be set on the ground and the hoisting line slackened.

In this mode the pawls will deny rotation of the lower half of the spiral coupling and cause the upper half to be superelevated, lifting the dead load with it. Each time it completes a full rotation (360°) the top half will fall back onto the lower half again. Thus, each completed rotation of the drive shaft will result in both a vertically downward hammer blow to the nose cone, and a simultaneous expulsion of water out of the well screen into the surrounding ground. This extruded water serves to diminish the lateral soil pressures which would otherwise restrain the cylindrical body from moving downwardly, while the hammer blows actively impel further penetration.

It is essential that for the duration of the penetration mode the hoisting line should remain slack. However, when the module is used in its alternate screen de-smearing mode, while all other mechanical procedures are exactly the same, the hoisting line should remain taut, so as to hold the hardware at the fixed elevation chosen by the operator.

During normal operation of the hydrodynamic compactor indications of well screen smearing/blockage will be evidenced by a reduction of seepage water discharge from the top of the deployment casing. At, or just below this point, or below a known cohesive seam/layer, the hoisting line should be locked in place and the same procedure as described above for the penetration mode enacted.

With the poker suspended in the ground by the hoisting line the tamping action of the dead weight will cause vertical vibration along the length of the well screen and will produce inertial forces tending to shake loose soil caught in the openings of the helically wound wire. Simultaneously, pressurized jets of water rush up the vertical spaces between the well screen ribs and the perforated pipe as a result of its forced expulsion from beneath the dead weight as it reoccupies the cone cavity. These streams of water are conveyed through water conduits of the nose cone and discharge into the circumferential water groove inside the cone collar.

It is believed that the combined effects of the vertical vibrations and the pressurized water jets washing action will be sufficient to result in the removal of finer grained soils types from smearing the well screen and thereby restoring the permeability of the water intake filter. By the operator choosing to initiate this remote screen cleansing procedure, the original permeability of the well screen filter may be restored, while the hydrodynamic compacter remains at depth within the ground.

Other Situations of Potential Benefit

Despite the fact that the foregoing description of the apparatus has been, for convenience of illustration, explained in terms of the specific embodiment restraints required by the particular demands of the hydrodynamic compactor's geometry, it will be obvious to those familiar/expert in the fields of water well installation and maintenance, and to petroleum drilling contractors, that this novelty can readily be adapted so as to be of some utility in their work.

For instance, in terms of water well installation it is possible that, in certain weaker soils, this apparatus would allow screens to be set in place and developed without the need for drilling a borehole. Also, it seems obvious that a modification of this tool could be used to renew the former conductivity of older wells, be they either sources of water or of petroleum.

The invention claimed is:

1. An apparatus for enhancing the utility of a parent device intended to improve the geotechnical characteristics of saturated ground, the apparatus comprising:

a. A module added to said parent device which can both enable said parent device to more easily penetrate said saturated ground and simultaneously improving the ability of said parent device to achieve more effective interaction with the water phase of said saturated ground through which said parent device is traversing; and b. Where the parent device is a hydrodynamic compactor of cylindrical shape which enters said saturated ground vertically with the circular section of said parent device being horizontal; and c. Where the said module fits within said parent device and said module can be activated remotely while said parent device is at depth within said saturated ground; and d. Where the lower part of said parent device which is in contact with the upper part of said module is comprised of, among other elements:

i. An axially aligned drive shaft capable of rotation in both directions;

ii. A short section of well screen forming the outer perimeter of said parent device; and iii. A conically shaped nose cone forming the bottom-most element of said parent device; and, iv. Where an accessible part of said parent device is filled with water to at least the level of the top of said well screen; and, e. Where said module is comprised of three necessary elements the top-most element being a loosely fitting spline shaft, said spline shaft terminating in a hanger at the lower end of the spline shaft; beneath which said spline shaft a two-piece spiral coupling resides; and with the lowermost element being a dead weight; and f. Where said drive shaft is fixedly connected to the top half of said spiral coupling, but thereafter passes freely through the lower half of said spiral coupling; and, g. Where said dead weight is contained loosely within a nose cavity drilled out of said nose cone; and, h. Where water conduits extend from the base of said nose cavity to the spaces between ribs at the base of said well screen.

2. The apparatus as defined in claim 1, further comprising improving the physical characteristics of mine tailings by increasing the bulk density of said mine tailings with the consequential benefits of increasing the shear strength of said mine tailings by causing a reduction in the void space occupied by water; and of reducing the overall volume occupied by said mine tailings; and, of releasing water previously entrapped in said mine tailings allowing for subsequent reuse.

3. A method to improve either the geotechnical characteristics of saturated ground, or the physical characteristics of mine tailings, using the apparatus of claim 1, while accomplishing such improvement without compromising the normal functionality of said parent device, and achieving these benefits while continuing to traverse the saturated ground or mine tailings, by reversing the direction of rotation of said axially aligned drive shaft, thereby activating said module with the following results:

a. Where the upper half of said spiral coupling is forced to rotate while the lower half of said spiral coupling is prevented from rotation; and, b. Where such relative motion results in said dead weight being alternatively raised and then subsequently abruptly dropped with each full rotation of said axially aligned drive shaft; and, c. Where raising said dead weight draws water into the space vacated by said dead weight; and, d. Where the abrupt falling of said dead weight expels water from the space previously occupied by said dead weight through said water conduits incorporated within said nose cone, and such pressurized water thereafter being ejected through openings in said well screen thereby ridding said well screen of any particles of said subject material clogging the openings in said well screen; and, e. Where the restoration of maximum perviousness of said well screen openings both optimizes the performance of said parent device, and reduces the frictional resistance between said parent device and said material through which it is moving; and, f. Where said dead weight produces a vertical impact load on the bottom of said nose cone cavity with each fall, thereby promoting penetration of said parent device through said material.

* * * * *